US011828504B2

(12) United States Patent
Chhajed et al.

(10) Patent No.: US 11,828,504 B2
(45) Date of Patent: Nov. 28, 2023

(54) HEAT EXCHANGER FOR AN APPLIANCE

(71) Applicant: WHIRLPOOL CORPORATION, Benton Harbor, MI (US)

(72) Inventors: Rahul Subhash Chhajed, Pune (IN); Deepak Gajanan Mankar, Pune (IN)

(73) Assignee: Whirlpool Corporation, Benton Harbor, MI (US)

( * ) Notice: Subject to any disclaimer, the term of this patent is extended or adjusted under 35 U.S.C. 154(b) by 210 days.

(21) Appl. No.: 17/027,203

(22) Filed: Sep. 21, 2020

(65) Prior Publication Data

US 2022/0090831 A1 Mar. 24, 2022

(51) Int. Cl.

| | |
|---|---|
| ***F25B 41/40*** | (2021.01) |
| ***F25B 41/37*** | (2021.01) |
| ***F25D 23/06*** | (2006.01) |
| ***F25D 11/02*** | (2006.01) |

(52) U.S. Cl.

CPC ..... *F25B 41/40* (2021.01); *F25B 41/37* (2021.01); *F25D 23/061* (2013.01); *F25B 2400/052* (2013.01); *F25B 2400/054* (2013.01); *F25D 11/022* (2013.01)

(58) Field of Classification Search

CPC ..... F25B 41/37; F25B 41/40

See application file for complete search history.

(56) References Cited

U.S. PATENT DOCUMENTS

| | | | | |
|---|---|---|---|---|
| 2,161,293 | A | 6/1939 | Heath | |
| 2,181,856 | A | 11/1939 | McCloy | |
| 6,543,529 | B2 | 4/2003 | Ohgaki | |
| 2005/0150249 | A1 | 7/2005 | Ha | |
| 2007/0180853 | A1 * | 8/2007 | Lim | F25B 40/00 62/513 |

(Continued)

FOREIGN PATENT DOCUMENTS

| | | | |
|---|---|---|---|
| DE | 1601015 | A1 | 6/1970 |
| DE | 112017000376 | T5 | 9/2018 |

(Continued)

OTHER PUBLICATIONS

Contact Definition & Meaning—Merriam-Webster, https://www.merriam-webster.com/dictionary/contact, accessed 2022 (Year: 2022).*

*Primary Examiner* — Paul Alvare
*Assistant Examiner* — Bejeir Brooks
(74) *Attorney, Agent, or Firm* — Price Heneveld LLP

(57) ABSTRACT

An appliance includes a refrigeration compartment that is defined by a plurality of interior walls. A freezer compartment is positioned proximate to the refrigeration compartment. A compressor is positioned proximate to at least one of the refrigeration compartment and the freezer compartment. A first evaporator is operably coupled to the compressor. A suction line is operably coupled to the first evaporator and is configured to convey refrigerant from the first evaporator toward the compressor. The suction line includes a suction line looping portion that generally defines an inner suction line loop and an outer suction line loop. A capillary tube is operably coupled to the first evaporator and is configured to convey refrigerant to the first evaporator. The capillary tube is configured to contact the suction line looping portion, such that heat from the capillary tube is transferred to the suction line.

13 Claims, 7 Drawing Sheets

(56) References Cited

U.S. PATENT DOCUMENTS

| | | | | |
|---|---|---|---|---|
| 2013/0219951 | A1* | 8/2013 | Hyun | F25B 41/37 29/428 |
| 2019/0011171 | A1* | 1/2019 | Kang | F25D 19/006 |
| 2019/0195543 | A1* | 6/2019 | Shi | F25C 1/04 |
| 2021/0222927 | A1* | 7/2021 | Wu | F25B 41/20 |
| 2022/0290900 | A1* | 9/2022 | Park | F25B 49/022 |

FOREIGN PATENT DOCUMENTS

| | | | | |
|---|---|---|---|---|
| DE | 102019200673 | A1 | | 7/2020 |
| GB | 886234 | | | 1/1962 |
| JP | 9113096 | A | | 5/1997 |
| JP | H09113096 | A | * | 5/1997 |
| JP | 2002181398 | A | | 6/2002 |

* cited by examiner

HEAT EXCHANGER FOR AN APPLIANCE

BACKGROUND

The present disclosure generally relates to a heat exchanger and, more specifically, to a heat exchanger for an appliance.

SUMMARY

According to one aspect of the present disclosure, an appliance includes a refrigeration compartment defined by a plurality of interior walls. A freezer compartment is proximate to the refrigeration compartment. A compressor is positioned proximate to at least one of the refrigeration compartment and the freezer compartment. A first evaporator is operably coupled to the compressor. A suction line conveys refrigerant from the first evaporator toward the compressor. The suction line has a suction line looping portion that generally defines an inner suction line loop and an outer suction line loop. A capillary tube is operably coupled to the first evaporator and is configured to convey refrigerant to the evaporator. The capillary tube contacts the suction line looping portion, such that heat from the capillary tube is transferred to the suction line.

According to another aspect of the present disclosure, an appliance includes a compressor. An evaporator is operably coupled to the compressor. A suction line is operably coupled to the evaporator and is configured to convey refrigerant from the evaporator toward the compressor. The suction line has a suction line looping portion that generally spirals to form a plurality of suction line loops. A capillary tube is operably coupled to the evaporator and is configured to convey refrigerant to the evaporator. The capillary tube contacts the suction line looping portion, such that heat from the capillary tube is transferred to the suction line.

According to another aspect of the present disclosure, an appliance includes a compressor. An evaporator is operably coupled to the compressor. A suction line is operably coupled to the evaporator and is configured to convey refrigerant from the evaporator toward the compressor. The suction line has a suction line looping portion that extends to form at least one suction line loop. A pressure reduction device is thermally coupled to the suction line looping portion, such that heat from the pressure reduction device is transferred to the suction line.

These and other features, advantages, and objects of the present invention will be further understood and appreciated by those skilled in the art by reference to the following specification, claims, and appended drawings.

Figure 1:
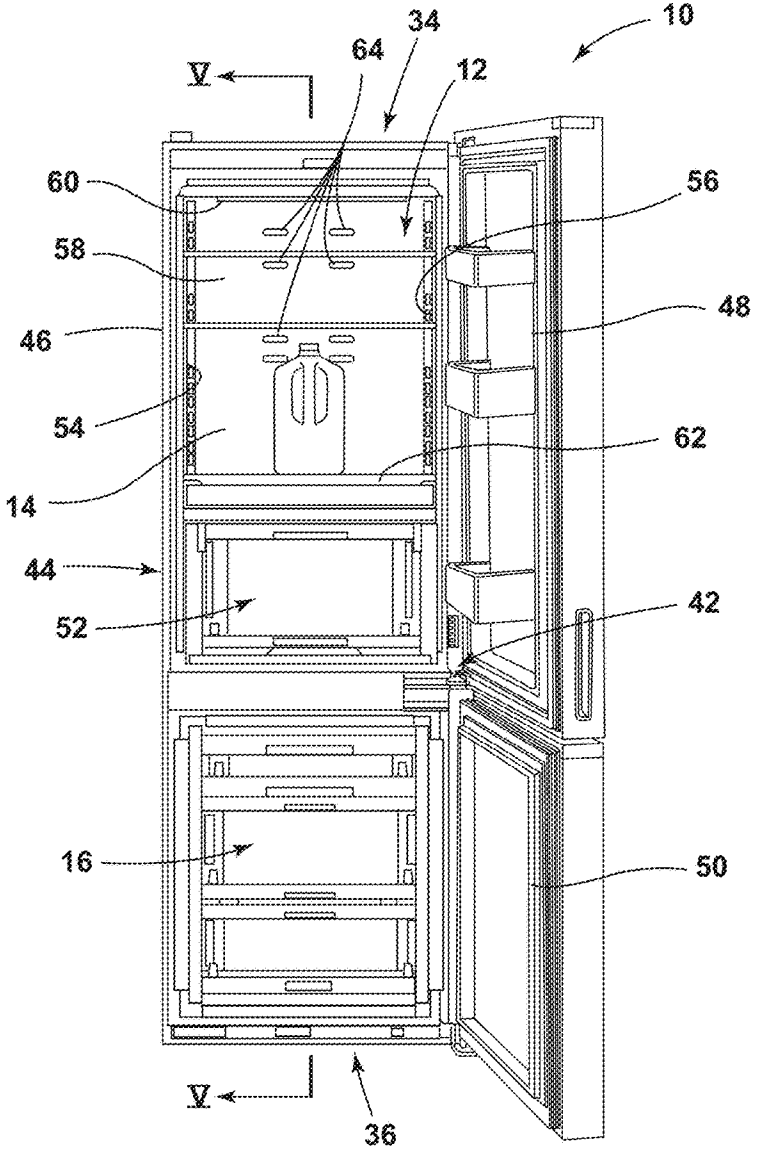
FIG. 1 is a front elevational view of an appliance of the present disclosure.

The components in the figures are not necessarily to scale, emphasis instead being placed upon illustrating the principles described herein.

DETAILED DESCRIPTION

The present illustrated embodiments reside primarily in combinations of method steps and apparatus components related to an appliance. Accordingly, the apparatus components and method steps have been represented, where appropriate, by conventional symbols in the drawings, showing only those specific details that are pertinent to understanding the embodiments of the present disclosure so as not to obscure the disclosure with details that will be readily apparent to those of ordinary skill in the art having the benefit of the description herein. Further, like numerals in the description and drawings represent like elements.

For purposes of description herein, the terms "upper," "lower," "right," "left," "rear," "front," "vertical," "horizontal," and derivatives thereof shall relate to the disclosure as oriented in FIG. 1. Unless stated otherwise, the term "front" shall refer to the surface of the element closer to an intended viewer, and the term "rear" shall refer to the surface of the element further from the intended viewer. However, it is to be understood that the disclosure may assume various alternative orientations, except where expressly specified to the contrary. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

The terms "including," "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element preceded by "comprises a . . . " does not, without more constraints, preclude the existence of additional identical elements in the process, method, article, or apparatus that comprises the element.

Referring to FIGS. 1-9, a reference numeral designates the appliance. The appliance 10 includes a refrigeration compartment 12 that is defined by a plurality of interior walls 14. A freezer compartment 16 is positioned proximate to the refrigeration compartment 12. A compressor 18 is positioned proximate to at least one of the refrigeration compartment 12 and the freezer compartment 16. A first evaporator 20 is operably coupled to the compressor 18. A suction line 24 is operably coupled to the first evaporator 20 and is configured to convey refrigerant 22 from the first evaporator 20 toward the compressor 18. The suction line 24 includes a suction line looping portion 26 that generally defines an inner suction line loop 28 and an outer suction line loop 30. A capillary tube 32 is operably coupled to the first evaporator 20 and is configured to convey refrigerant 22 to the first evaporator 20. The capillary tube 32 is configured to contact the suction line looping portion 26, such that heat from the capillary tube 32 is transferred to the suction line 24.

Referring now to FIGS. 1-5 the appliance 10 includes a top 34 and a bottom 36 opposite the top 34. A front side 38 and a rear side 40 opposite the front side 38 extend between the top 34 and the bottom 36. A right side 42 and a left side 44 opposite the right side 42 are disposed between the front and rear sides 38, 40 and extend between the top 34 and the bottom 36. Exterior surfaces 46 of the appliance 10, such as trim or paneling, may comprise the top 34, bottom 36, rear side 40, left side 44, and/or right side 42 of the appliance 10. As illustrated in FIG. 1, the appliance 10 includes a refrigeration compartment door 48 and a freezer compartment door 50. The refrigeration and freezer compartment doors 48, 50 are coupled to the appliance 10 proximate to the front side 38 and are operable between closed positions and open positions, as illustrated in FIG. 1. In the closed positions (not shown), the exterior surfaces 46 of the refrigeration and freezer compartment doors 48, 50 may be the front side 38 of the appliance 10. In the illustrated embodiment, the refrigeration compartment door 48 provides access to the refrigeration compartment 12 and a sub compartment 52 positioned between the refrigeration compartment 12 and the freezer compartment 16. A variety of styles of appliances with varying numbers of compartments and/or doors are contemplated.

Referring further to FIGS. 1-5, the refrigeration compartment 12 is positioned nearer to the top 34 of the appliance 10 than the freezer compartment 16. As such, the appliance 10 is configured as a bottom freezer refrigeration appliance. The refrigeration compartment 12 is defined by the plurality of interior walls 14. As illustrated in FIG. 1, the refrigeration compartment 12 is defined by a first side interior wall 54 proximate to the left side 44 of the appliance 10, a second side interior wall 56 opposite the first side interior wall 54 and proximate to the right side 42 of the appliance 10, a rear interior wall 58 positioned between the first and second side interior walls 54, 56 and generally proximate to the rear side 40 of the appliance 10, an upper interior wall 60 extending outward from the rear interior wall 58, between the first and second side interior walls 54, 56, and generally proximate to the top 34 of the appliance 10, and a lower interior wall 62 extending between the first and second side interior walls 54, 56 opposite the upper interior wall 60.

In some implementations, at least one air circulation opening 64 may be defined by and/or extend through at least one of the plurality of interior walls 14 that define the refrigeration compartment 12. For example, in the embodiment illustrated in FIG. 1, a plurality of air circulation openings 64 are defined by the rear interior wall 58. The air circulation openings 64 may enhance air circulation within the refrigeration compartment 12 by allowing air being pushed over the first evaporator 20 by a first evaporator fan 66 to flow into the refrigeration compartment 12, as described further herein.

Figure 2:
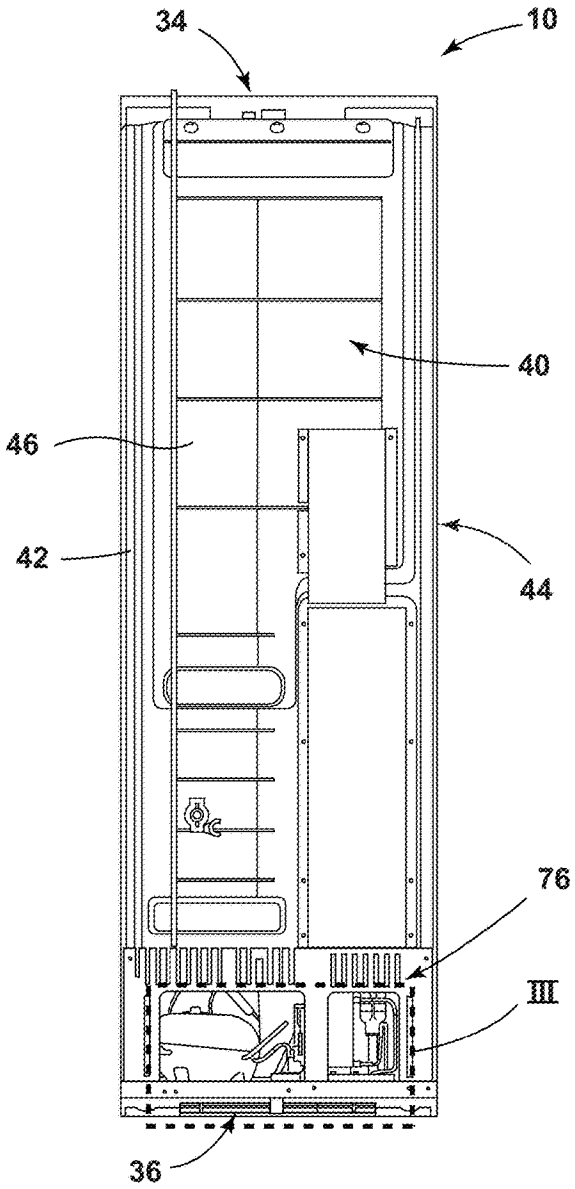
FIG. 2 is a rear elevational view of the appliance of FIG. 1 showing a machine compartment.
Figure 3:
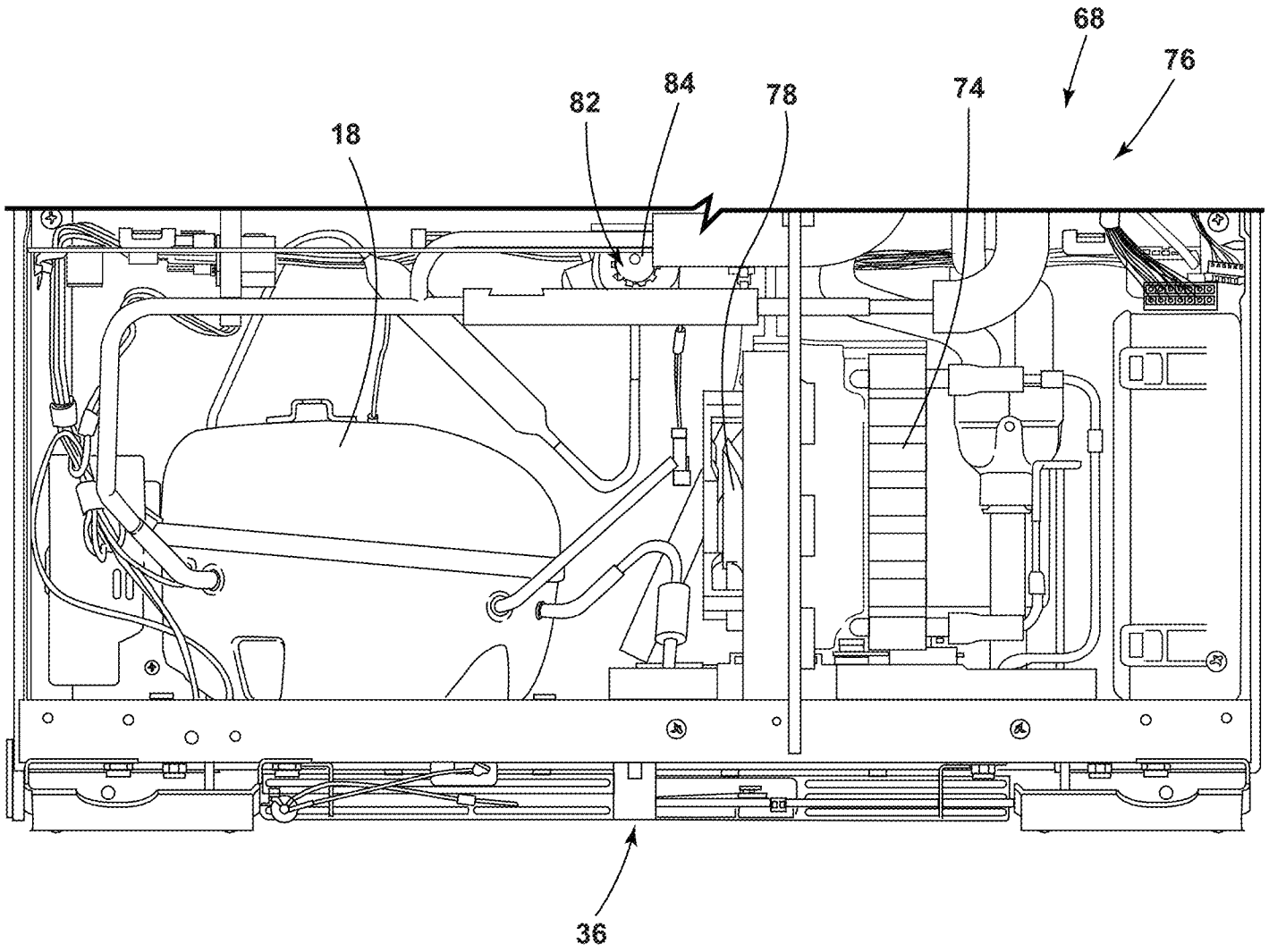
FIG. 3 is a rear elevational view of the machine compartment of FIG. 2 taken at area III.

Referring now to FIGS. 2-8, the appliance 10 includes a cooling system 68 that utilizes a refrigerant circuit 70. In the refrigerant circuit 70, the compressor 18 supplies refrigerant 22 through a compressor outlet line 72 to a condenser 74, as illustrated in FIGS. 2 and 3 and shown schematically in FIG. 4. In the embodiment of the appliance 10 illustrated in FIGS. 2 and 3, the compressor 18 and the condenser 74 are positioned within a machine compartment 76 of the appliance 10 that is adjacent to the freezer compartment 16 proximate to the bottom and rear side 36, 40 of the appliance 10. The condenser 74 is paired with a condenser fan 78, which is shown schematically in FIG. 4 and illustrated within the machine compartment 76 in FIG. 3. The condenser fan 78 operates to further improve the efficiency of the condenser 74 by imparting a flow of ambient air over the condenser 74. This additional air flow over the condenser 74 facilitates additional heat transfer (i.e., heat removal) during the phase change of refrigerant 22 from a gas to a liquid within the condenser 74.

Next, the refrigerant 22 exits the condenser 74 via a conduit, passes through a filter 80, and is presented to a valve system 82. In the schematic diagram in FIG. 4, the valve system 82 is configured as a single, three-way valve assembly 84 configured to direct and/or restrict flow of the refrigerant 22 to the first evaporator 20 and/or a second evaporator 86. Alternatively, the valve system 82 may be configured as two, one-way valve assemblies for accomplishing the same function as the one, three-way valve assembly 84. In implementations where the appliance 10 employs a dual, one-way valve configuration for the valve system 82 within the refrigerant circuit 70, a first one-way valve (not shown) may be arranged upstream from the first evaporator 20 and a second one-way valve (not shown) may be arranged upstream from the second evaporator 86. Both one-way valves can then be operated to direct or restrict flow of refrigerant 22 to one or both of the first and second evaporators 20, 86. A variety of configurations of the valve system 82 are contemplated.

Figure 7:
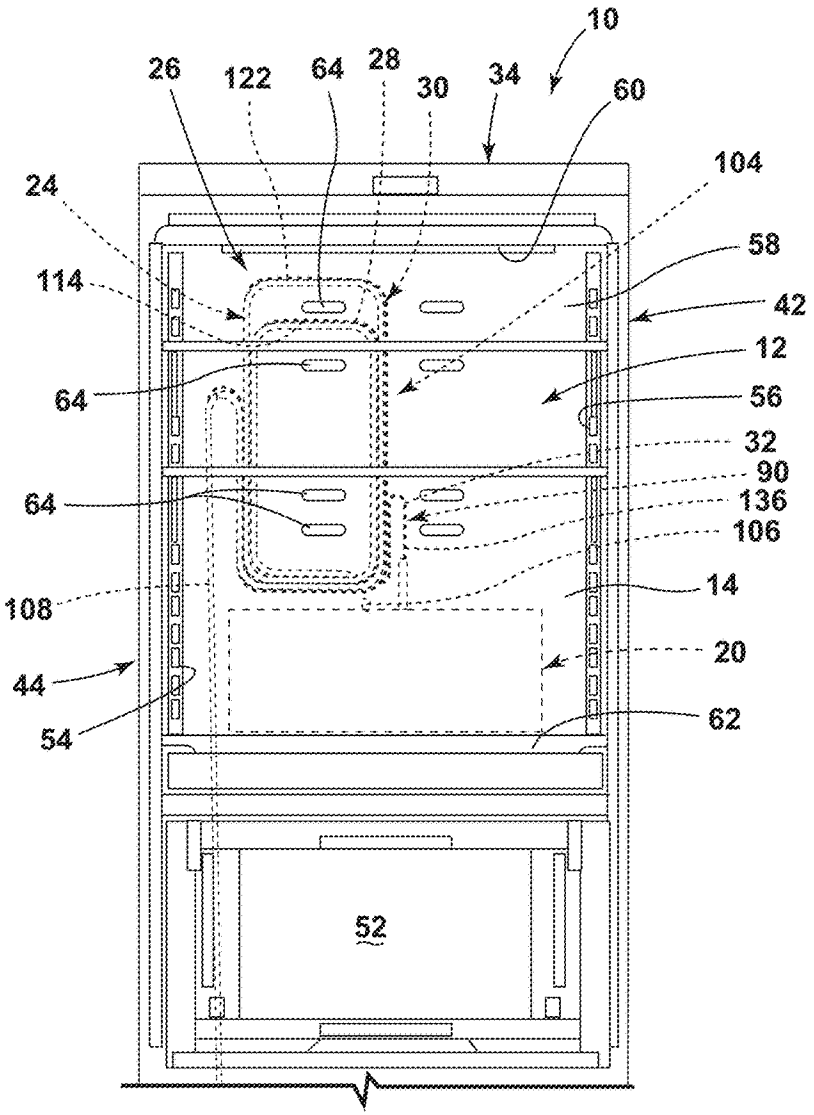
FIG. 7 is a partial front elevational view of the refrigeration compartment of the appliance showing a rear interior wall of the refrigeration compartment defining a plurality of air circulation openings, a suction line looping portion of the suction line in phantom, and a capillary tube looping portion of the capillary tube in phantom.
Figure 9:
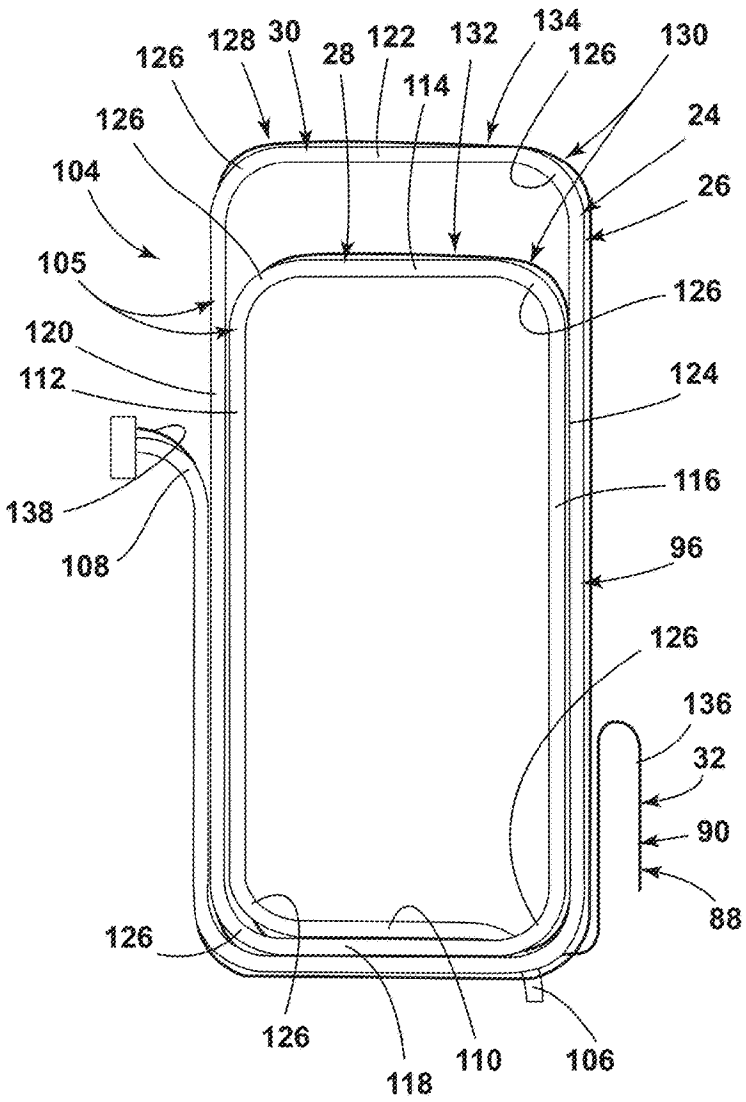
FIG. 9 is a front elevational view of a suction line looping portion, and a capillary looping portion of the present disclosure.
Figure 8:
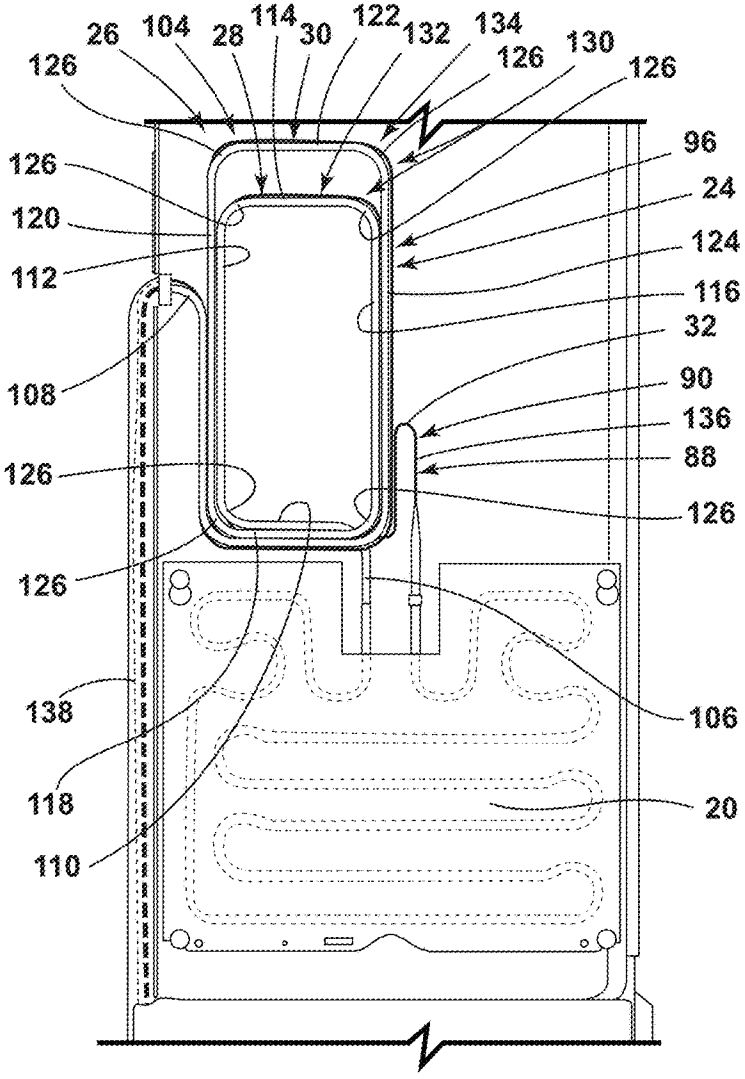
FIG. 8 is a partial front elevational view of a rear portion of a refrigeration compartment of the appliance showing the evaporator, the suction line looping portion, and the capillary tube looping portion.

Both lines leading into the first and second evaporators 20, 86 from the valve system 82 are configured with pressure reduction devices 88. Thus, after passing through the valve system 82, the refrigerant 22 that flows to the first evaporator 20 flows through a first pressure reduction device 90 and refrigerant 22 that flows to the second evaporator 86 flows through a second pressure reduction device 92. The pressure reduction devices 88 may be at least one of a variety of devices configured to reduce pressure that includes, but is not limited to, capillary tubes, expansion valves, orifice restrictors, needle valves and/or a combination thereof. Furthermore, the first and second pressure reduction devices 90, 92 can each be configured to subject the refrigerant 22 to particular pressure reduction levels according to the particular design and operational needs of the appliance 10. In FIGS. 7-9, the first pressure reduction device 90 is illustrated as the capillary tube 32. Likewise, in FIG. 4, the first pressure reduction device 90 is the capillary tube 32.

When refrigerant 22 existing in a liquid state flows through the first pressure reduction device 90 and/or the second pressure reduction device 92, the refrigerant 22 experiences a significant pressure and temperature drop. Thus, a substantial quantity of refrigerant 22 flashes to a vapor state during flow through the first and/or second pressure reduction devices 90, 92. It will be appreciated that the refrigerant 22 may be composed of one or more of a variety of conventional coolants employed in the refrigeration industry. For example, the refrigerant 22 may be R-134a, R-600a or other recognized refrigerants for vapor compression systems.

Figure 6:
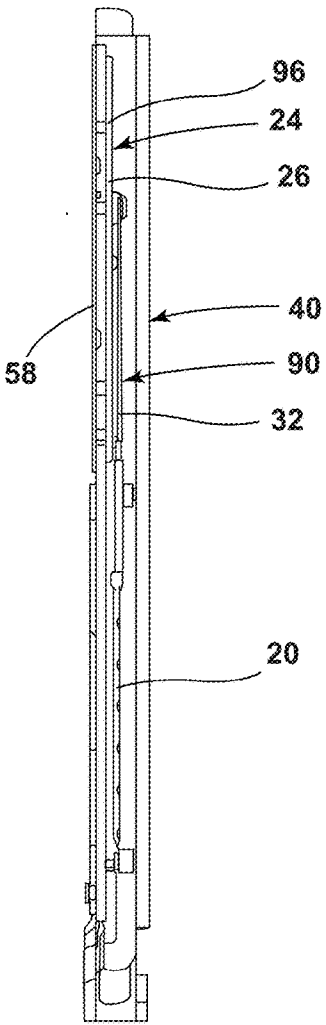
FIG. 6 is an enlarged view of the evaporator and the suction line of FIG. 5 taken at area VI.
Figure 5:
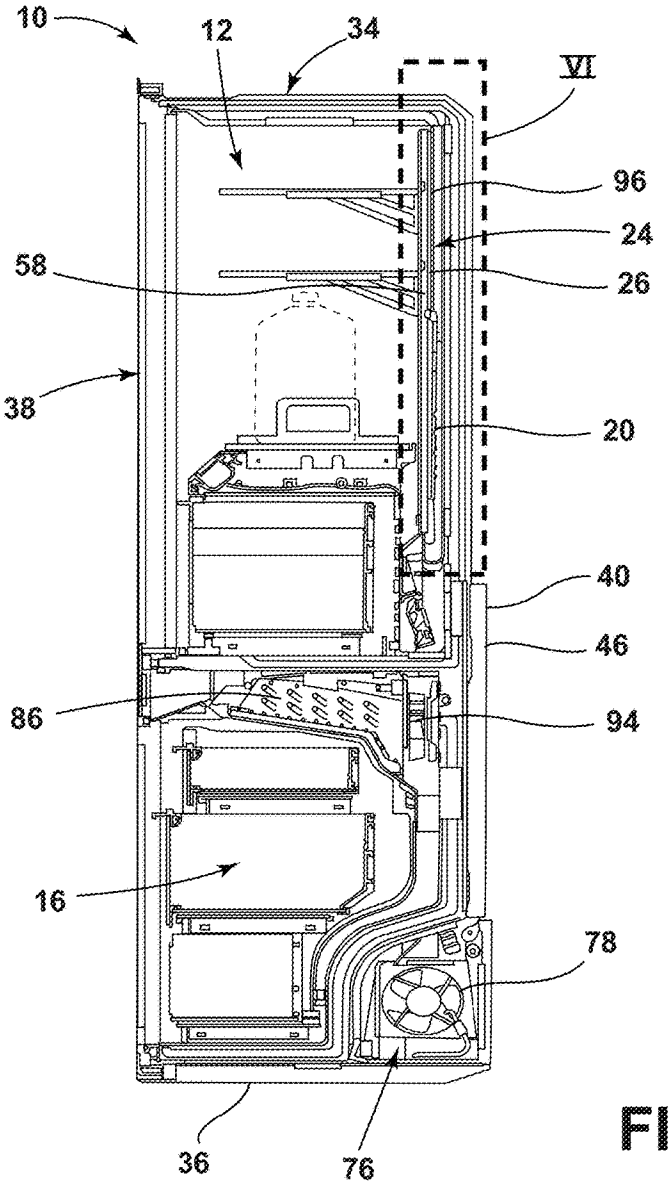
FIG. 5 is a cross-sectional view of the appliance of FIG. 1 taken at line V-V showing an evaporator and a suction line coupled to the evaporator.

After flowing through the first and second pressure reduction devices 90, 92, the refrigerant 22 enters the first and second evaporators 20, 86, respectively. The first evaporator 20 is arranged in thermal communication with the refrigeration compartment 12. As illustrated in FIGS. 5 and 6, the first evaporator 20 is positioned between the rear side 40 of the appliance 10 and the rear interior wall 58 of the refrigeration compartment 12 and between the freezer compartment 16 and the top 34 of the appliance 10. As illustrated in FIG. 5, the first evaporator fan 66 is positioned within the appliance 10 proximate to the first evaporator 20 and is configured to direct warm air over the first evaporator 20. Flow of refrigerant 22 through the first evaporator 20 cools the warm air as it flows over the first evaporator 20. The cooled air flows through the air circulation openings 64 defined by the rear interior wall 58 into the refrigeration compartment 12, which cools the refrigeration compartment 12.

The second evaporator 86 is in thermal communication with the freezer compartment 16. As illustrated in FIG. 5, the second evaporator 86 is positioned adjacent to the freezer compartment 16, and a second evaporator fan 94 is positioned proximate to the second evaporator 86. The second evaporator fan 94 directs warm air over the second evaporator 86. This cools the air, which in turn, cools the freezer compartment 16 in thermal communication with the second evaporator 86.

Figure 4:
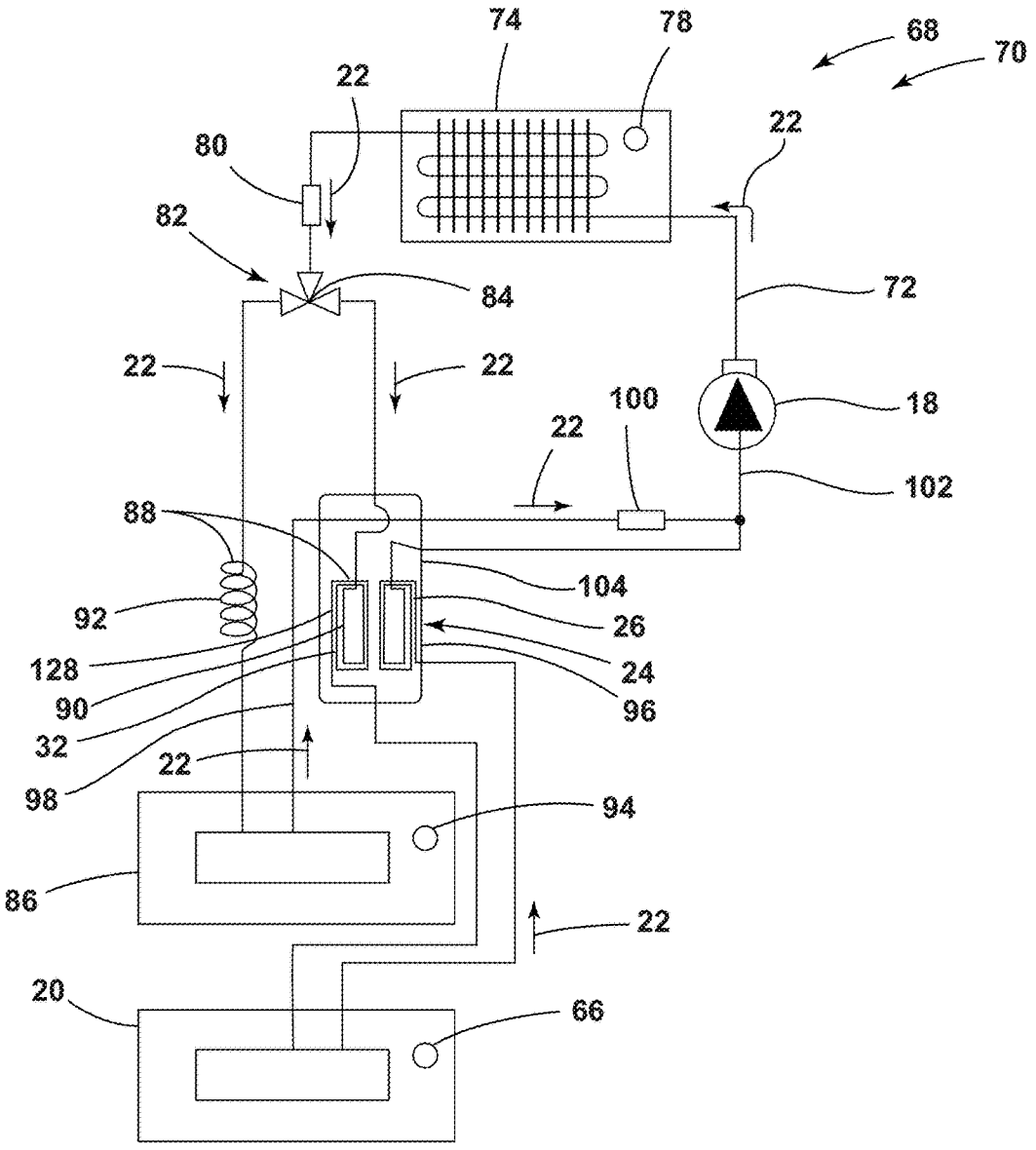
FIG. 4 is a schematic diagram of a refrigeration cycle of an appliance of the present disclosure.

As illustrated in FIG. 4, a first suction line 96 exits the first evaporator 20, and a second suction line 98 exits the second evaporator 86. A check valve 100 is provided on the second suction line 98. The first and second suction lines 96, 98 join in a compressor inlet line 102 that extends to the compressor 18. The refrigerant 22, thus, flows from the first and second evaporators 20, 86, through the first and second suction lines 96, 98, into the compressor inlet line 102, and back to the compressor 18. In various implementations, the appliance 10 may include a controller that is configured to control a variety of components involved in the refrigerant circuit 70 (e.g., compressor 18, valve system 82, etc.) to operate the cooling system 68.

Referring now to FIGS. 4-9, the first suction line 96 and the first pressure reduction device 90 coupled to the first evaporator 20 are configured to form a heat exchanger 104, wherein heat from the first pressure reduction device 90 is transferred to the first suction line 96. The first suction line 96 includes the suction line looping portion 26. The suction line looping portion 26 includes at least one suction line loop 105. In other words, the first suction line 96 is configured to extend, such that the first suction line 96 forms at least one loop. In some examples, the suction line looping portion 26 may generally define a plurality of suction line loops 105. In some implementations, the suction line looping portion 26 may generally spiral to form a plurality of suction line loops 105. Further, in some examples, the suction line looping portion 26 may generally spiral in a progressively widening fashion to create a plurality of suction line loops 105 of varying sizes.

For example, in the embodiment illustrated in FIGS. 7-9, the suction line looping portion 26 generally spirals in a progressively widening fashion to form the inner suction line loop 28 and the outer suction line loop 30. As viewed in FIG. 8, the first suction line 96 initially extends upward from the first evaporator 20. The first suction line 96 then turns toward the left side 44 of the appliance 10, loops clockwise, and crosses over itself on the side of the first suction line 96 nearer to the front side 38 of the appliance 10 to form the inner suction line loop 28. The section of the first suction line 96 that extends upward from the first evaporator 20 to the beginning of the inner suction line loop 28 may be referred to as the suction line standing end 106. As such, the inner suction line loop 28 begins by extending from the suction line standing end 106 and terminates by crossing over the suction line standing end 106.

As the inner suction line loop 28 crosses over the suction line standing end 106, the outer suction line loop 30 begins. Like the inner suction line loop 28, the outer suction line loop 30 initially extends toward the left side 44 of the appliance 10, then loops clockwise and crosses over the suction line standing end 106. As illustrated in FIG. 8, the outer suction line loop 30 crosses over the suction line standing end 106 between the front of the refrigeration compartment 12 and the suction line standing end 106. Because the suction line looping portion 26 generally spirals in a progressively widening fashion to define the inner and outer suction line loops 28, 30, the outer suction line loop 30 loops generally around and outside of the inner suction line loop 28. As such, the outer suction line loop 30 is longer than the inner suction line loop 28 and crosses the suction line standing end 106 between the first evaporator 20 and the inner suction line loop 28.

As the outer suction line loop 30 crosses over the suction line standing end 106, the outer suction line loop 30 ends and a suction line tag end 108 begins. As illustrated in FIG. 8, the suction line tag end 108 extends along the outside of the outer suction line loop 30 toward the left side 44 of the appliance 10 and then upward toward the top 34 of the appliance 10 before extending further toward the left side 44 of the appliance 10 away from the outer suction line loop 30 and downward toward the bottom 36 of the appliance 10. The suction line tag end 108 of the first suction line 96 is operably coupled with the compressor 18, such that the refrigerant 22 flows through the first evaporator 20, into the suction line standing end 106, through the inner suction line loop 28, through the outer suction line loop 30, into the suction line tag end 108, and then on to the compressor 18.

As illustrated in FIGS. 8 and 9, the inner and outer suction line loops 28, 30 include a plurality of elongated portions. For example, the inner suction line loop 28 includes an inner lower portion 110 that extends from the suction line standing end 106 toward the left side 44 of the appliance 10, a first inner side portion 112 extends upward from the inner lower portion 110 toward the top 34 of the appliance 10, an inner upper portion 114 that extends from the first inner side portion 112 toward the right side 42 of the appliance 10, and a second inner side portion 116 that extends downward from the inner upper portion 114 toward the bottom 36 of the appliance 10. Further, the outer suction line loop 30 includes an outer lower portion 118 that extends from the suction line standing end 106 toward the left side 44 of the appliance 10, a first outer side portion 120 extends upward from the outer lower portion 118 toward the top 34 of the appliance 10, an outer upper portion 122 that extends from the first outer side portion 120 toward the right side 42 of the appliance 10, and a second outer side portion 124 that extends downward from the outer upper portion 122 toward the bottom 36 of the appliance 10.

As illustrated in FIGS. 8 and 9, the inner upper and lower portions 114, 110 may be generally parallel to each other, and the first and second inner side portions 112, 116 may be generally parallel to each other and/or generally perpendicular to the inner upper and lower portions 114, 110. The outer upper and lower portions 122, 118 may be generally parallel to each other, and the first and second outer side portions 120, 124 may be generally parallel to each other and/or generally perpendicular to the outer upper and lower portions 122, 118. Further, the corresponding portions of the inner and outer suction line loops 28, 30 may be generally parallel to each other. For example, the inner and outer upper portions 114, 122 may be generally parallel to each other, and the first inner and outer side portions 112, 120 may be generally parallel to each other.

Referring still to FIGS. 7-9, the elongated portions of the inner and outer suction line loops 28, 30 may be connected to each other via a plurality of corners 126. As illustrated in FIGS. 8 and 9, a plurality of generally rounded corners 126 connect the portions of the inner and outer suction line loops 28, 30, and the first and second inner and outer side portions 112, 116, 120, 124 are longer than the inner and outer lower and upper portions 110, 118, 114, 122, respectively, such that the inner and outer suction line loops 28, 30 are generally stadium shaped. Of the corresponding elongated portions of the inner and outer suction line loops 28, 30 illustrated in FIGS. 7-9, the inner and outer upper portions 114, 122 are spaced apart from each other to the greatest extent. In other words, the inner and outer upper portions 114, 122 are positioned a distance from each other that is greater than the distances between the inner and outer lower portions 110, 118, the first inner and outer side portions 112, 120, and the second inner and outer side portions 116, 124, respectively.

As illustrated in FIGS. 5 and 6, the inner and outer suction line loops 28, 30 may be aligned with each other in a forward-rearward direction of the appliance 10, such that a flat spiral is formed. In other words, apart from the circumference of the first suction line 96, the inner and outer suction line loops 28, 30 may be configured to spiral without extending toward the front side 38 or the rear side 40 of the appliance 10. It is contemplated, that in some examples, the suction line looping portion 26 may be positioned adjacent to other sides of the appliance 10, such as the left side 44, and that the suction line looping portion 26 may form a flat spiral that loops without extending toward the left side 44 or right side 42 of the appliance 10. A variety of suction line looping portion 26 designs are contemplated. For example, suction line looping portions 26 having more or fewer loops, a variety of loop shapes (circular, rectangular, oval, etc.), and various loop sizes, are contemplated.

Referring now to FIGS. 7-9, the first pressure reduction device 90 is configured to form a heat exchanger 104 with the suction line looping portion 26 of the first suction line 96. In the embodiment illustrated in FIGS. 7-9, the first pressure reduction device 90 is the capillary tube 32. The capillary tube 32 may be thermally coupled to and/or in contact with the suction line looping portion 26 of the first suction line 96, such that heat may be transferred from the capillary tube 32 to the first suction line 96. In some embodiments, the capillary tube 32 may be soldered to the suction line looping portion 26. In some embodiments, the capillary tube 32 and the suction line looping portion 26 may be thermally coupled and held in contact with each other by vinyl heat shrink tubing disposed about the capillary tube 32 and suction line looping portion 26. Further, in some embodiments, the capillary tube 32 and the suction line looping portion 26 may be thermally coupled and held in contact with each other by aluminum tape adhered to the capillary tube 32 and the suction line looping portion 26. In some examples, the aluminum tape may extend generally parallel to the directions of extension of the capillary tube 32 and the suction line looping portion 26. Further, in some examples, the aluminum tape may extend generally perpendicularly to the directions of extension of the capillary tube 32 and the suction line looping portion 26 and wrap around the capillary tube 32 and the suction line looping portion 26. The capillary tube 32 includes a capillary tube looping portion 128. The capillary tube looping portion 128 includes at least one capillary tube loop 130. In other words, the capillary tube 32 is configured to extend, such that the capillary tube 32 forms at least one loop. In some examples, the capillary tube looping portion 128 may generally define a plurality of capillary tube loops 130. In some implementations, the capillary tube looping portion 128 may generally spiral to form a plurality of capillary tube loops 130. Further, in some examples, the capillary tube looping portion 128 may generally spiral in a progressively widening fashion to form a plurality of capillary tube loops 130 of varying sizes.

For example, in the embodiment illustrated in FIGS. 7-9, the capillary tube looping portion 128 generally spirals in a progressively widening fashion to form an inner capillary tube loop 132 and an outer capillary tube loop 134. As viewed in FIG. 8, a capillary tube standing end 136 extends outward from the first evaporator 20. The capillary tube 32 extends from the capillary tube standing end 136 toward the left side 44 of the appliance 10, loops clockwise, and crosses over the capillary tube standing end 136 to form the inner capillary tube loop 132.

As the inner capillary tube loop 132 crosses over the capillary tube standing end 136, the outer capillary tube loop 134 begins. Like the inner capillary tube loop 132, the outer capillary tube loop 134 initially extends toward the left side 44 of the appliance 10, then loops clockwise and crosses over the capillary tube standing end 136. Because the capillary tube looping portion 128 generally spirals in a progressively widening fashion to define the inner and outer capillary tube loops 132, 134, the outer capillary tube loop 134 loops generally around and outside of the inner capillary tube loop 132. As such, the outer capillary tube loop 134 is longer than the inner capillary tube loop 132 and crosses the capillary tube standing end 136 between the first evaporator 20 and the inner capillary tube loop 132.

As the outer capillary tube loop 134 crosses over the capillary tube standing end 136, the outer capillary tube loop 134 ends and a capillary tube tag end 138 begins. As illustrated in FIG. 8, the capillary tube tag end 138 extends along the outside of the outer capillary tube loop 134 toward the left side 44 of the appliance 10 and then upward toward the top 34 of the appliance 10 before extending further toward the left side 44 of the appliance 10 away from the outer capillary tube loop 134 and downward toward the bottom 36 of the appliance 10.

As illustrated in FIGS. 8 and 9, the inner and outer capillary tube loops 132, 134 extend along and generally form the same shapes as the inner and outer suction line loops 28, 30, respectively. The capillary tube looping portion 128 extending along the suction line looping portion 26 in this manner may allow a large portion of the capillary tube looping portion 128 to be thermally coupled with and/or in contact with the suction line looping portion 26, which may increase heat transfer from the capillary tube 32 to the first suction line 96. The suction line and capillary tube looping portions 26, 128 may form an efficient heat exchanger 104.

Referring now to FIGS. 5-7, in various implementations, at least one of the plurality of interior walls 14 may be positioned between the refrigeration compartment 12 and the suction line looping portion 26 and/or between the refrigeration compartment 12 and the capillary tube looping portion 128. For example, the suction line looping portion 26 and/or the capillary tube looping portion 128 may be positioned between the rear side 40 of the appliance 10 and the rear interior wall 58 of appliance 10 that defines the refrigeration compartment 12, such that the rear interior wall 58 is positioned between the refrigeration compartment 12 and the suction line looping portion 26 and/or the capillary tube looping portion 128, as illustrated in FIGS. 5 and 6.

In various implementations, the first evaporator 20 may be positioned between the rear interior wall 58 and the rear side 40 of the appliance 10. In the embodiment illustrated in FIG. 4, the suction line looping portion 26 is positioned a first distance from the top 34 of the appliance 10, and the first evaporator 20 is positioned a second distance from the top 34 of the appliance 10, wherein the second distance is greater than the first distance. In other words, the suction line looping portion 26 is positioned nearer than the first evaporator 20 to the top 34 of the appliance 10. Further, as illustrated in FIG. 4, the second evaporator 86 is positioned a third distance from the top 34 of the appliance 10, wherein the third distance is greater than the second distance. In other words, the first evaporator 20 is nearer than the second evaporator 86 to the top 34 of the appliance 10.

In some implementations, the suction line looping portion 26 may be positioned adjacent to at least one of the plurality of interior walls 14 of the appliance 10, such that at least one air circulation opening 64 defined by the at least one of the plurality of interior walls 14 may be disposed generally between the inner and outer suction line loops 28, 30 of the suction line looping portion 26. Further, in some implementations, the suction line looping portion 26 may be positioned such that the inner and outer suction line loops 28, 30 generally spiral around the at least one air circulation opening 64 defined by the at least one of the plurality of interior walls 14.

For example, the suction line looping portion 26 is illustrated in phantom in FIG. 7 positioned adjacent to the refrigeration compartment 12, above the first evaporator 20, and rearward of the rear interior wall 58 that defines the refrigeration compartment 12 (i.e., between the rear interior wall 58 and the rear side 40 of the appliance 10). In the illustrated embodiment, the rear interior wall 58 defines eight air circulation openings 64. As illustrated, the inner suction line loop 28 loops around three of the air circulation openings 64, and the outer suction line loop 30 loops around those three air circulation openings 64, and additionally, loops around a fourth air circulation opening 64 positioned upward of the inner suction line loop 28 (i.e., between the inner suction line loop 28 and the top 34 of the appliance 10). As such, the inner and outer suction line loops 28, 30 generally spiral around the three air circulation openings 64, and the fourth air circulation opening 64 is disposed generally between the inner and outer suction line loops 28, 30. In particular, the air circulation opening 64 positioned between the inner and outer suction line loops 28, 30 is positioned between the inner upper portion 114 and the outer upper portion 122 of the inner and outer suction line loops 28, 30, respectively. As illustrated the inner and outer capillary tube loops 132, 134, likewise, loop about at least one of the air circulation openings 64, and at least one of the air circulation openings 64 is positioned between the inner and outer capillary tube loops 132, 134. Positioning the suction line looping portion 26 and/or the capillary tube looping portion 128 in this manner may be advantageous, as the suction line looping portion 26 and/or the capillary tube looping portion 128 may not be visible through the plurality of air circulation openings 64 to a user looking into the refrigeration compartment 12.

The present disclosure may provide a variety of additional advantages. First, the first suction line 96 having the suction line looping portion 26 increases the length of the first suction line 96, which increases the length of the heat exchanger 104, which may increase the coefficient of performance of the refrigerant circuit 70. Second, the suction line looping portion 26 and the capillary tube looping portion 128 being thermally coupled to form the heat exchanger 104 may aid in reducing liquid flood-back problems within the refrigerant circuit 70 that can negatively impact compressor life and cause condensation to accumulate on the first suction line 96. As such, improved compressor life may result from the heat exchanger 104. Third, the suction line looping portion 26 and the capillary tube looping portion 128 may form a heat exchanger 104 that is space efficient compared to other components typically used to avoid liquid flood back (e.g., an accumulator, etc.). Fourth, the suction line looping portion 26 and the capillary tube looping portion 128 being utilized to form the heat exchanger 104 may reduce structure borne noise and airborne noise of the appliance 10 relative to conventional systems.

According to one aspect, an appliance includes a refrigeration compartment defined by a plurality of interior walls. A freezer compartment is proximate to the refrigeration compartment. A compressor is positioned proximate to at least one of the refrigeration compartment and the freezer compartment. A first evaporator is operably coupled to the compressor. A suction line conveys refrigerant from the first evaporator toward the compressor. The suction line has a suction line looping portion that generally defines an inner suction line loop and an outer suction line loop. A capillary tube is operably coupled to the first evaporator and is configured to convey refrigerant to the evaporator. The capillary tube contacts the suction line looping portion, such that heat from the capillary tube is transferred to the suction line.

According to another aspect, at least one of the plurality of interior walls is positioned between the refrigeration compartment and the suction line looping portion and the at least one of the plurality of interior walls defines an air circulation opening disposed generally between the inner and outer suction line loops.

According to another aspect, at least one of the plurality of interior walls is positioned between the refrigeration compartment and the suction line looping portion and the at least one of the plurality of interior walls defines an air circulation opening. The inner and outer suction line loops generally spiral around the air circulation opening.

According to another aspect, the appliance includes a top and a bottom opposite the top. The refrigeration compartment is nearer than the freezer compartment to the top.

According to another aspect, the suction line looping portion is positioned a first distance from the top, and the first evaporator is positioned a second distance from the top. The second distance is greater than the first distance.

According to another aspect, the appliance includes a second evaporator operably coupled to the compressor and positioned proximate to the freezer compartment a third distance from the top. The third distance is greater than the second distance.

According to another aspect, the capillary tube includes a capillary tube looping portion that generally spirals in a progressively widening fashion to form an inner capillary tube loop and an outer capillary tube loop. The capillary tube looping portion contacts the suction line looping portion, such that heat is transferred from the capillary tube to the suction line.

According to another aspect, the appliance includes a compressor. An evaporator is operably coupled to the compressor. A suction line is operably coupled to the evaporator and configured to convey refrigerant from the evaporator toward the compressor. The suction line has a suction line looping portion that generally spirals to form a plurality of suction line loops. A capillary tube is operably coupled to the evaporator and is configured to convey refrigerant to the evaporator. The capillary tube contacts the suction line looping portion, such that heat from the capillary tube is transferred to the suction line.

According to another aspect, the suction line looping portion generally spirals in a progressively widening fashion to form an inner suction line loop and an outer suction line loop.

According to another aspect, the capillary tube includes a capillary tube looping portion that generally spirals to form a plurality of capillary tube loops. The capillary tube looping portion contacts the suction line looping portion, such that heat is transferred from the capillary tube to the suction line.

According to another aspect, the capillary tube looping portion generally spirals in a progressively widening fashion to form an inner capillary tube loop and an outer capillary tube loop.

According to another aspect, the appliance includes a top, a bottom opposite the top, a freezer compartment proximate to the bottom, and a refrigeration compartment nearer than the freezer compartment to the top.

According to another aspect, the suction line looping portion is positioned a first distance from the top, and the evaporator is positioned a second distance from the top. The second distance is greater than the first distance.

According to another aspect, the suction line looping portion is positioned between the top and the freezer compartment and is adjacent to the refrigeration compartment.

According to another aspect, an appliance includes a compressor. An evaporator is operably coupled to the compressor. A suction line is operably coupled to the evaporator and is configured to convey refrigerant from the evaporator toward the compressor. The suction line has a suction line looping portion that extends to form at least one suction line loop. A pressure reduction device is thermally coupled to the suction line looping portion, such that heat from the pressure reduction device is transferred to the suction line.

According to another aspect, the suction line looping portion generally spirals to form a plurality of suction line loops.

According to another aspect, the suction line looping portion generally spirals in a progressively widening fashion to form an inner suction line loop and an outer suction line loop.

According to another aspect, the pressure reduction device includes a capillary tube operably coupled to the evaporator and configured to convey refrigerant to the evaporator. The capillary tube is configured to contact the suction line looping portion, such that heat from the capillary tube is transferred to the suction line.

According to another aspect, the pressure reduction device includes a capillary tube operably coupled to the evaporator and configured to convey refrigerant to the evaporator. The capillary tube has a capillary tube looping portion that generally spirals to form a plurality of capillary tube loops. The capillary tube looping portion contacts the suction line looping portion, such that heat is transferred from the capillary tube to the suction line.

According to another aspect, the pressure reduction device includes a capillary tube operably coupled to the evaporator and configured to convey refrigerant to the evaporator. The capillary tube has a capillary tube looping portion that generally spirals to form an inner capillary tube loop and an outer capillary tube loop. The capillary tube looping portion contacts the suction line looping portion, such that heat is transferred from the capillary tube to the suction line.

It will be understood by one having ordinary skill in the art that construction of the described disclosure and other components is not limited to any specific material. Other exemplary embodiments of the disclosure disclosed herein may be formed from a wide variety of materials, unless described otherwise herein.

For purposes of this disclosure, the term "coupled" (in all of its forms, couple, coupling, coupled, etc.) generally means the joining of two components (electrical or mechanical) directly or indirectly to one another. Such joining may be stationary in nature or movable in nature. Such joining may be achieved with the two components (electrical or mechanical) and any additional intermediate members being integrally formed as a single unitary body with one another or with the two components. Such joining may be permanent in nature or may be removable or releasable in nature unless otherwise stated.

It is also important to note that the construction and arrangement of the elements of the disclosure as shown in the exemplary embodiments is illustrative only. Although only a few embodiments of the present innovations have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements shown as multiple parts may be integrally formed, the operation of the interfaces may be reversed or otherwise varied, the length or width of the structures and/or members or connector or other elements of the system may be varied, the nature or number of adjustment positions provided between the elements may be varied. It should be noted that the elements and/or assemblies of the system may be constructed from any of a wide variety of materials that provide sufficient strength or durability, in any of a wide variety of colors, textures, and combinations. Accordingly, all such modifications are intended to be included within the scope of the present innovations. Other substitutions, modifications, changes, and omissions may be made in the design, operating conditions, and arrangement of the desired and other exemplary embodiments without departing from the spirit of the present innovations.

It will be understood that any described processes or steps within described processes may be combined with other disclosed processes or steps to form structures within the scope of the present disclosure. The exemplary structures and processes disclosed herein are for illustrative purposes and are not to be construed as limiting.

What is claimed is:

1. An appliance, comprising:

a refrigeration compartment defined by a plurality of interior walls;

a compressor;

an evaporator operably coupled to the compressor;

a suction line operably coupled to the evaporator and configured to convey refrigerant from the evaporator toward the compressor, the suction line having a suction line looping portion that spirals to form an inner suction line loop and an outer suction line loop, wherein at least one of the plurality of interior walls is positioned between the refrigeration compartment and the suction line looping portion, the at least one interior wall defining an air circulation opening disposed between the inner and outer suction line loops; and a capillary tube operably coupled to the evaporator and configured to convey refrigerant to the evaporator, wherein the capillary tube contacts the suction line looping portion, such that heat from the capillary tube is transferred to the suction line.

2. The appliance of claim 1, wherein the suction line looping portion spirals in a progressively widening fashion to form the inner suction line loop and the outer suction line loop.

3. The appliance of claim 2, wherein the capillary tube comprises:

a capillary tube looping portion that spirals to form a plurality of capillary tube loops, wherein the capillary tube looping portion contacts the suction line looping portion, such that heat is transferred from the capillary tube to the suction line.

4. The appliance of claim 3, wherein the capillary tube looping portion spirals in a progressively widening fashion to form an inner capillary tube loop and an outer capillary tube loop.

5. The appliance of claim 1, further comprising:

a top;

a bottom opposite the top; and a freezer compartment proximate to the bottom, wherein the refrigeration compartment is nearer than the freezer compartment to the top.

6. The appliance of claim 5, wherein the suction line looping portion is positioned a first distance from the top, and the evaporator is positioned a second distance from the top, wherein the second distance is greater than the first distance.

7. The appliance of claim 5, wherein the suction line looping portion is positioned between the top and the freezer compartment and is adjacent to the refrigeration compartment.

8. An appliance, comprising:

a refrigeration compartment defined by a plurality of interior walls;

a freezer compartment proximate to the refrigeration compartment;

a compressor;

an evaporator operably coupled to the compressor;

a suction line operably coupled to the evaporator and configured to convey refrigerant from the evaporator toward the compressor, the suction line having a suction line looping portion that extends to form at least one suction line loop, wherein at least one of the plurality of interior walls is positioned between the refrigeration compartment and the suction line looping portion and the at least one of the plurality of interior walls defines an air circulation opening, and wherein the at least one suction line loop spirals around the air circulation opening; and a pressure reduction device thermally coupled to the suction line looping portion, such that heat from the pressure reduction device is transferred to the suction line.

9. The appliance of claim 8, wherein the suction line looping portion spirals to form a plurality of suction line loops.

10. The appliance of claim 9, wherein the suction line looping portion spirals in a progressively widening fashion to form an inner suction line loop and an outer suction line loop.

11. The appliance of claim 8, wherein the pressure reduction device comprises:

a capillary tube operably coupled to the evaporator and configured to convey refrigerant to the evaporator, the capillary tube being configured to contact the suction line looping portion, such that heat from the capillary tube is transferred to the suction line.

12. The appliance of claim 8, wherein the pressure reduction device comprises:

a capillary tube operably coupled to the evaporator and configured to convey refrigerant to the evaporator, the capillary tube having a capillary tube looping portion that spirals to form a plurality of capillary tube loops, wherein the capillary tube looping portion contacts the suction line looping portion, such that heat is transferred from the capillary tube to the suction line.

13. The appliance of claim 8, wherein the pressure reduction device comprises:

a capillary tube operably coupled to the evaporator and configured to convey refrigerant to the evaporator, the capillary tube having a capillary tube looping portion that spirals to form an inner capillary tube loop and an outer capillary tube loop, wherein the capillary tube looping portion contacts the suction line looping portion, such that heat is transferred from the capillary tube to the suction line.

* * * * *